US005772686A

United States Patent [19]

Caruana

[11] Patent Number: 5,772,686

[45] Date of Patent: Jun. 30, 1998

[54] PELVIC RETROVERTER

[76] Inventor: Patrick Caruana, 5, rue de l'Hôtel de Ville, 26400 Crest, France

[21] Appl. No.: 765,620

[22] PCT Filed: Apr. 29, 1996

[86] PCT No.: PCT/FR96/00649

§ 371 Date: May 14, 1997

§ 102(e) Date: May 14, 1997

[87] PCT Pub. No.: WO96/33779

PCT Pub. Date: Oct. 31, 1996

[30] Foreign Application Priority Data

Apr. 27, 1995 [FR] France ..... 95 05297

[51] Int. Cl.[6] ..... A61F 5/00

[52] U.S. Cl. ..... 606/240; 5/633

[58] Field of Search ..... 606/240, 241; 482/132, 140; 128/845, 870; 5/630, 633, 648

[56] References Cited

U.S. PATENT DOCUMENTS

| | | | |
|---|---|---|---|
| 726,055 | 4/1903 | Hartford | 606/240 |
| 2,494,094 | 1/1950 | Horstman . | |
| 2,818,854 | 1/1958 | Johnson | 606/240 |
| 4,475,542 | 10/1984 | Brossard | 606/240 |
| 4,483,329 | 11/1984 | Shamos | 606/240 |
| 4,785,801 | 11/1988 | Speece | 606/240 |
| 4,796,315 | 1/1989 | Crew | 606/240 X |
| 4,838,249 | 6/1989 | Jannotta . | |
| 4,848,742 | 7/1989 | Lindley et al. | 606/240 X |
| 4,989,591 | 2/1991 | Anders, Jr. | 606/240 |
| 5,106,083 | 4/1992 | Hall . | |
| 5,201,761 | 4/1993 | Serola | 606/240 |
| 5,352,173 | 10/1994 | McLaughlin . | |
| 5,611,765 | 3/1997 | Koch, Jr. | 606/240 X |
| 5,626,616 | 5/1997 | Speece | 606/240 |

FOREIGN PATENT DOCUMENTS

| | | | |
|---|---|---|---|
| 1941603 | 2/1971 | Germany | 606/240 |

*Primary Examiner*—Linda C. Dvorak
*Attorney, Agent, or Firm*—Bacon & Thomas

[57] ABSTRACT

The pelvis retroverter of the invention for straightening lumbar lordosis by retroverting the pelvis simultaneously with synergetic exercising of the abdominal, pelvis-trochanter, gluteal, ischio-tibialis, and lumbar muscles while reclining on the front, presents in succession in a direction specified by an axis of symmetry (3):

an ergonomic top face (1*a*) having a middle and recessed abdominal zone (4) between two ilium support zones (5), with a middle pubic support zone (6) behind, and an intermediate zone (7) in front; and a functional base (1*b*) separated from the face (1*a*) by a height (h) and coming into contact with the ground (2), comprising two plane zones (8 and 10) that are at an angle (c) to each other and interconnected by an arc (9).

13 Claims, 5 Drawing Sheets

PELVIC RETROVERTER

BACKGROUND OF THE INVENTION

The present invention relates to the general technical field of devices and appliances designed for developing and rebuilding the musculation of a person and making it possible, in particular, to perform specific sports training or reeducation of certain muscles of a person in a correct posture.

More particularly, the invention provides an appliance that is adapted to straightening lumbar lordosis by retroversion of the pelvis, while simultaneously working the abdominal, the pelvis-trochanter, and the gluteal muscles and also the muscles of the lumbar region while reclining on the front.

DESCRIPTION OF THE RELATED ART

The state of the art provides various appliances for strengthening or reeducating the muscles of the abdominal wall, of the pelvis-trochanter, gluteal muscles, and muscles of the lumbar region. Thus, it is well known to use stall bars or other accessories for holding the feet in place while performing movements that exercise the abdominal, gluteal, and lumbar muscles. It is also well known to use a conventional abdominal plank, a lumbar chair, a foam roller, a cushion, or a floor mat, for the purpose of performing various exercises often undertaken on the advice of a specialist. Another solution consists in using a special-purpose variable-load muscle-building machine.

In use, the above-described appliances have led to the observation that they suffer from undeniable practical difficulties. To be effective some of those appliances need a qualified person to be present in order to ensure that proper retroversion of the pelvis is executed or in order to ensure that muscle-building movements are performed properly and without danger with respect to abdominal, pelvis-trochanter, gluteal, or lumbar muscles. Those appliances do not make it possible to perform special work for the purpose of obtaining synergy and proper balance of the muscles concerned while also correcting the movements performed.

In addition, known appliances often take up a lot of space, are expensive to buy, or cater for a limited range of exercises only.

SUMMARY OF THE INVENTION

The present invention seeks to remedy the above-specified drawbacks by proposing, in particular, an appliance that provides hypercorrective work for abdominal wall, pelvis-trochanter, and gluteal muscles by retroversion of the pelvis while straightening the lumbar spine in the general sense and also suitable for use in a small amount of space.

The invention also seeks to provide an appliance enabling a person to work specifically on the abdominal, pelvis-trochanter, gluteal, and lumbar muscles specifically without risk of trauma, even in the absence of advice from a qualified person and without prior knowledge of biomechanical and muscle-strengthening techniques.

The invention also seeks to alleviate compression on the disks between the vertebrae by straightening the lumbar region.

To achieve these objects, the muscle-building appliance of the invention is implemented in the form of a shaped, rigid, and inextensible structure having in succession in a given direction on a longitudinal axis of symmetry:

an ergonomic top face comprising:

a middle abdominal zone, that is inclined forwards to a greater or lesser extent, that is situated on the axis of symmetry, and that has a forwardly-open recess;

a back pubic support, situated in the horizontal plane, and forming an angle with the preceding zone;

two side zones for supporting the top-front ilium ridges, which zones are raised relative to the pubic support zone, located on either side of the abdominal recess, and symmetrical about the axis of symmetry; and a front intermediate zone having the abdominal zone passing therethrough; and a functional base coming into contact with the ground, determining the movement trajectory, and comprising: two plane zones interconnected by a circular or elliptical arc determining a tilting angle for the pelvis.

Various other characteristics appear from the following description given with reference to the accompanying drawings which show embodiments of the invention as non-limiting examples.

DETAILED DESCRIPTION OF THE INVENTION

Figure 1:
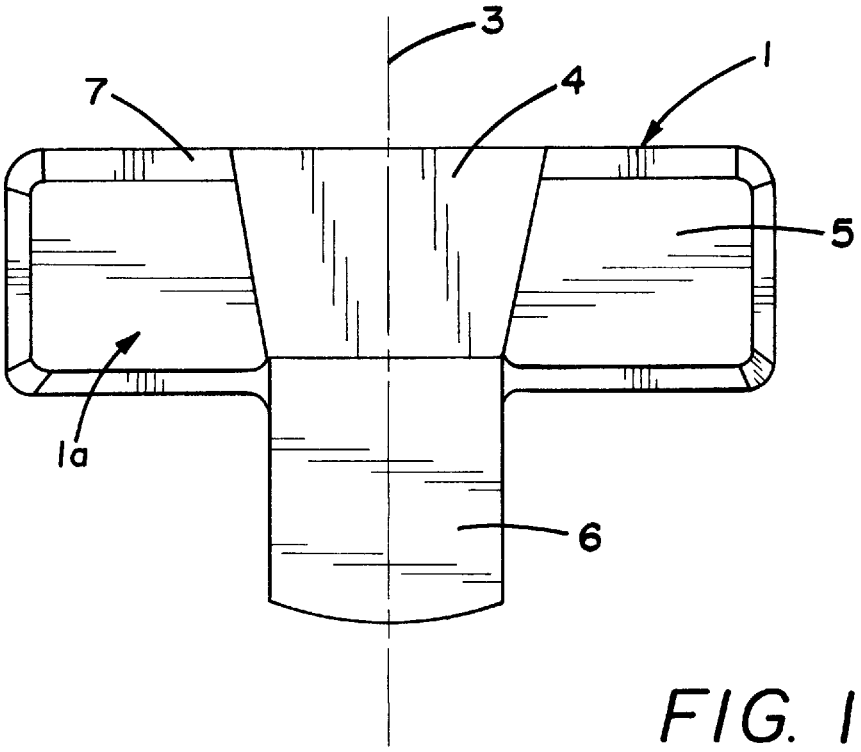
FIG. 1 is a plan view of an embodiment of a pelvis retroverter of the invention.
Figure 2:
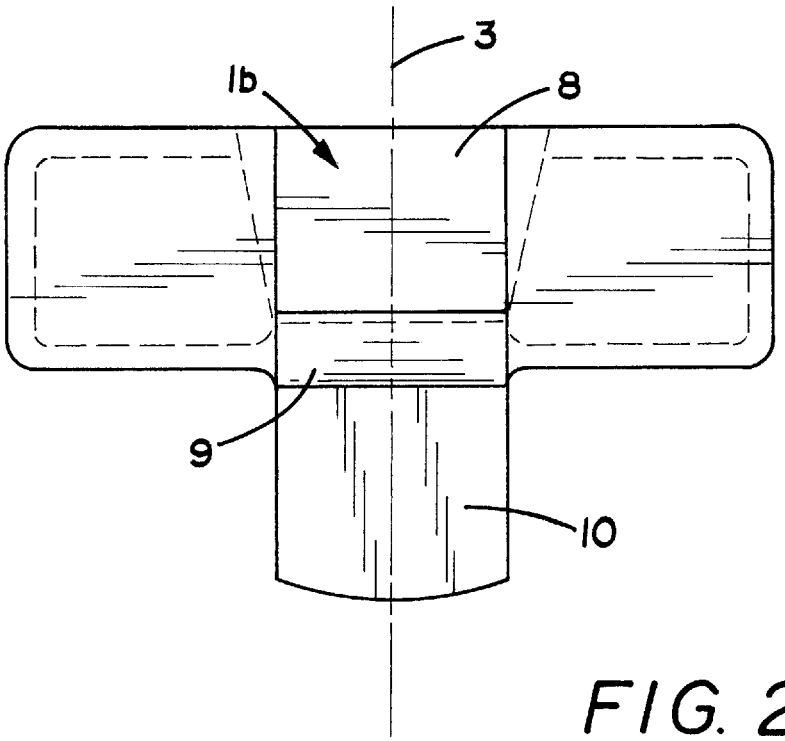
FIG. 2 is a view from beneath of an embodiment of a pelvis retroverter of the invention.
Figure 3:
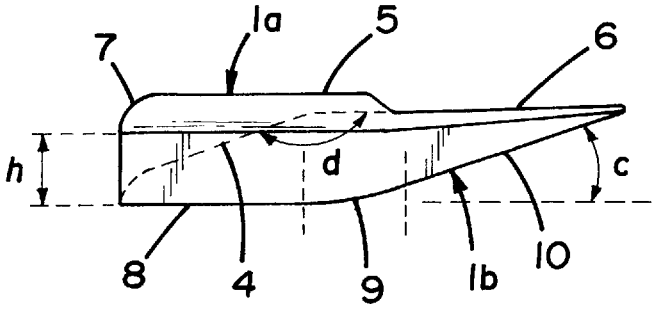
FIG. 3 is a side view of an embodiment of a pelvis retroverter of the invention.

As can be seen more specifically in FIGS. 1 to 3, the device of the invention for retroversion of the pelvis and for straightening the lumbar region of the spine simultaneously with synergetic working of the muscles, essentially of the abdominal region, of the pelvis-trochanter region, and the gluteal muscles of a person P is implemented in the form of a shaped structure 1 designed, when not in use to be placed on the ground 2 in the broad sense. The general shape of the pelvic retroverter 1 is described within a transversely-elongate rectangular parallelogram, and in the example shown, it constitutes a T-shape about an axis of symmetry 3.

The pelvic retroverter has a top face 1*a* situated in a horizontal plane and located above the ground 2, that is designed to constitute a surface for ergonomic support of the user, and a base 1*b* that comes into contact with the ground 2. The face 1*a* is separated from the furthest-away portion of the base 1*b*, and consequently from the ground 2, by a height h that is sufficient to enable retroversion to be performed correctly, as can be seen in FIG. 3. According to the invention, the pelvic retroverter 1 has two ilium support zones 5 on its top face 1*a* disposed symmetrically about the axis 3 for receiving the top front ilium ridge portions 17 of the pelvis. The pelvis retroverter has an abdominal recess 4 that is inclined to a greater or lesser extent, open to the front, and centered on the axis of symmetry 3, extending between the ilium support zones 5 over a given width so as to leave the ilium support zones 5 in a raised position while releasing the abdomen so as to avoid impeding respiration and contraction of the abdominal muscles. According to the invention, the pelvis retroverter 1 is also provided with a pubic support surface 6 situated in the horizontal plane and centered on the axis 3 behind the zones 5 and extending the recessed zone 4, for the purpose of receiving the pubis 18 of the user. The connection between the zones 4 and 6 forms an angle d that is obtuse to a greater or lesser extent. Advantageously, this surface is made flexible and comfortable by fabricating, overmolding, or sticking on a pad. In accordance with the invention, the pelvis retroverter also has an intermediate zone 7 of rounded shape that is interrupted partly or completely by the zone 4 as a function of the angle of inclination defined between the pubic support 6 and the middle abdominal zone 4, and situated vertically in front of and below the zones 4 and 5 remote from the pubic zone 6.

Figure 7:
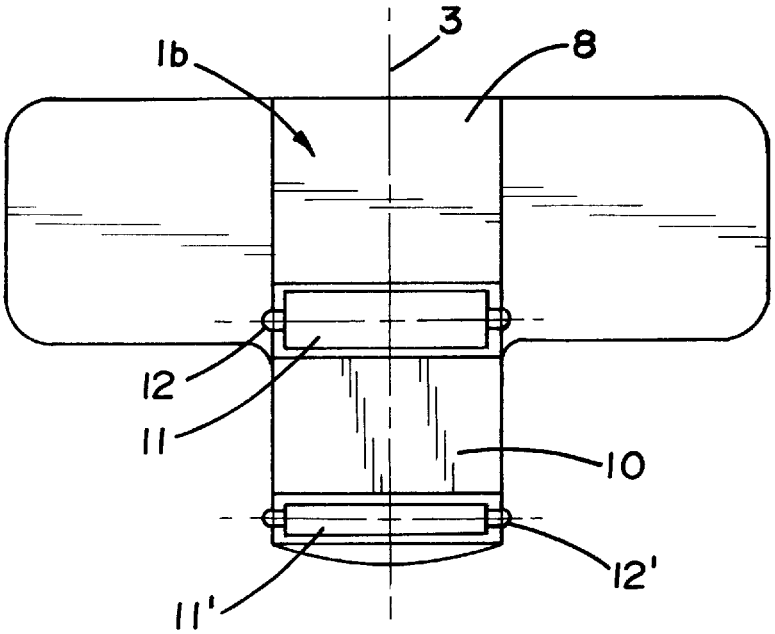
FIG. 7 shows an embodiment of the base of the pelvis retroverter.
Figure 8:
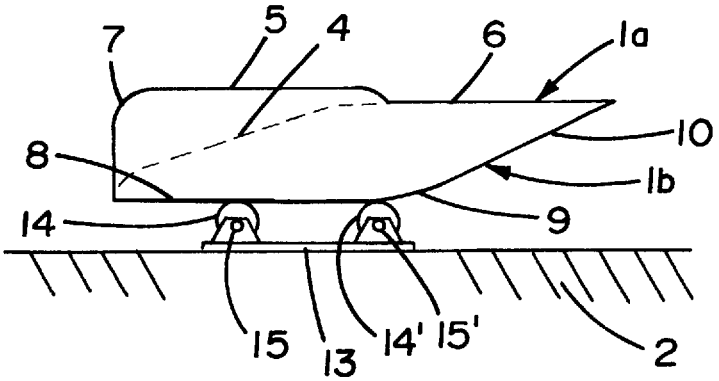
FIG. 8 shows another embodiment of the base of the pelvis retroverter.

As shown in FIG. 2, the pelvic retroverter 1 has a base 1*b* whose function is to define a trajectory so as to generate retroversion of the pelvis. In the example shown, it has a preferably middle portion provided with a zone 8 that is plane and parallel to the ground 2, situated in the example shown beneath the zone 4 and separated from the face 1*a* by a height h, a smooth zone 10 that is preferably slippery and also plane connected at one end to the zone 8 via an arc 9 and at its other end to the pubic support zone 6, as can be seen in FIG. 3. In the example shown, the zone 10 forms an angle c of about 20° relative to the ground, but this angle may be greater or smaller without going beyond the ambit of the invention and remaining within the operating limits on its use. The arc 9 whose origin is situated approximately vertically relative to the connection between the zones 4 and 6 is circular or elliptical and represents the slip-rotation zone that gives rise to retroversion of the pelvis. Its radius must be large enough for the phenomenon of pelvis rocking to be possible. Another solution that provides the same advantages is shown in FIG. 7 and comprises cylinders 11 and 11' that are mounted to rotate freely about axes 12 and 12' located at the position of the arc 9 and at the opposite end of the zone 10, for example. By way of example, FIG. 8 shows another type of embodiment of the pelvis retroverter. This figure shows the invention resting on a stationary cradle 13 provided with two cylinders 14 and 14' that are free to rotate about respective axes 15 and 15'. The arc 9 of largest radius is located on the two cylinders.

Figure 9:
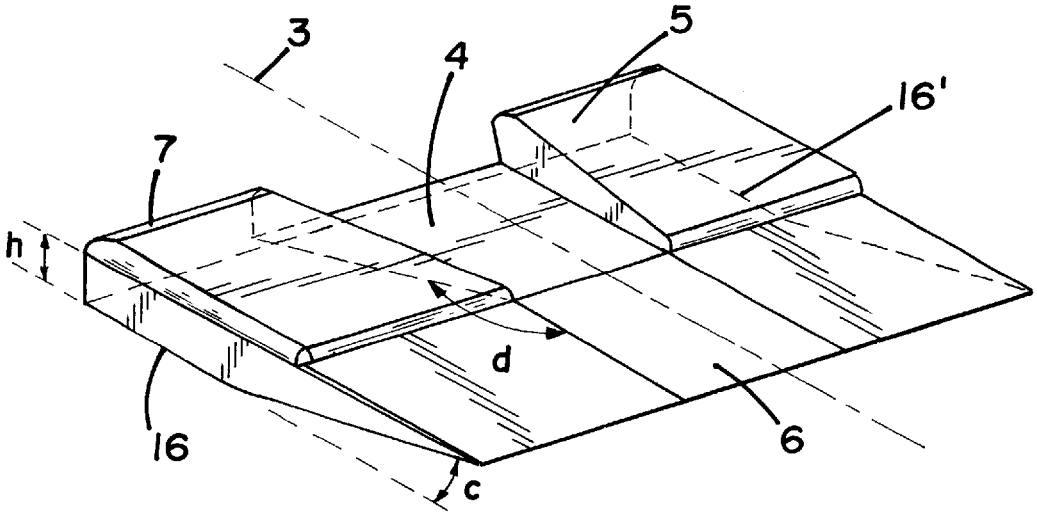
FIG. 9 is a perspective view of the pelvis retroverter.

The functional base 1*b* may also extend over the entire width of the pelvis retroverter, as shown in FIG. 9. Its trajectory can also be defined in this way via its edges constituted by two edge portions 16 and 16'.

In a wider context of a pelvis retroverter, whatever the way in which it is embodied, it can be integrated in a practitioner's treatment couch to constitute a portion of a system for corrective positioning of a person reclining on the front.

Figure 5:
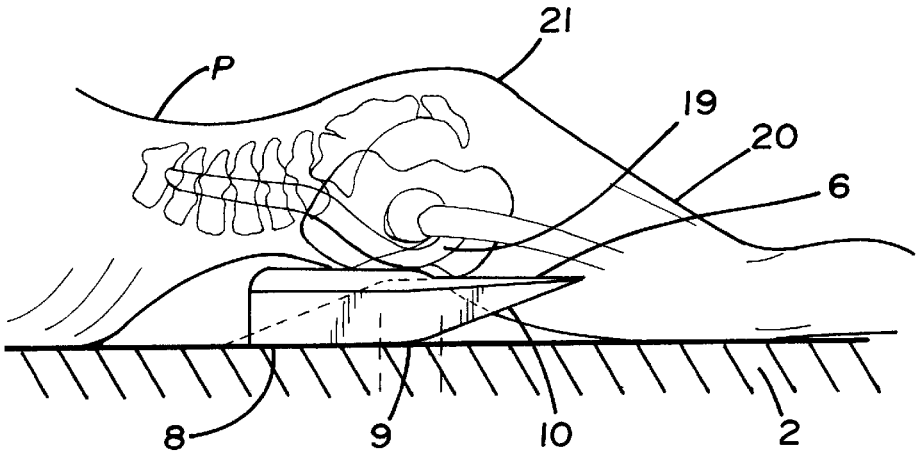
FIG. 5 is a sagittal section showing the position of the user in the rest position on the pelvis retroverter of the invention.

In accordance with the invention, when in the non-use position, the pelvis retroverter rests on the plane zone 8 as shown in FIG. 5. This zone is made plane in order to avoid the opposite phenomenon to retroversion, i.e. hyperlordosis.

The pelvis retroverter as described above can be made in various models of dimensions adapted to the sizes of users. Whatever the size of a pelvis retroverter, each retroverter comprises in succession in a direction defined by its longitudinal axis 3: a top face 1*a* having a recessed middle abdominal zone 4 that slopes forwards to a greater or lesser extent, between two ilium zones 5 for supporting the top front ilium ridges 17; a horizontal pubic support zone 6 for the pubis 18 and extending the zone 4 backwards; a vertical intermediate zone 7 interrupted completely or partly by the abdominal zone 4; and a base 1*b* which has a plane surface 8 connected to the plane and smooth surface 10 by a circular or elliptical arc 9 at one end and to the face 1*a* via the bottom middle portion of the zone 7 at the other end. The angle c between the surface 10 and the ground 2 is about 20°.

Practical use of the pelvis retroverter 1 of the invention stems directly from the above description.

Figure 4:
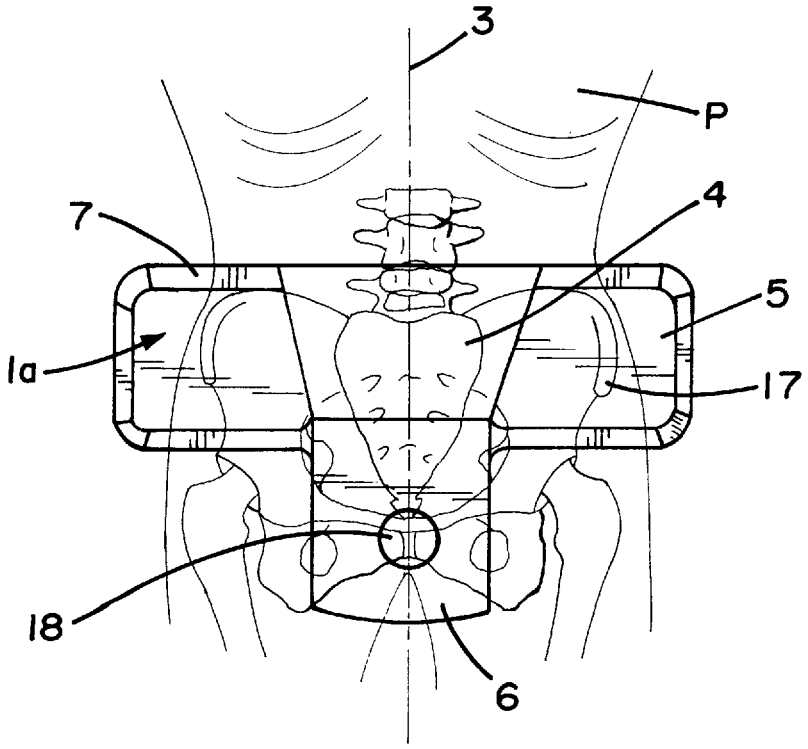
FIG. 4 is a plan view showing how the retroverter of the invention is used, in the rest position.

The pelvis retroverter is placed on the ground 2 so that its surface 8 of its base 1*b* is on the ground. The person P who is going to use the pelvis retroverter lies face down on the ground 2 placing its ilium support zones 5 beneath the top front ilium ridges 17 as shown in FIGS. 4 and 5. The pubis 18 of the person is positioned in the pubic support zone 6. At this stage, the base 1*b* is supported on the ground solely by the zone 8.

Figure 6:
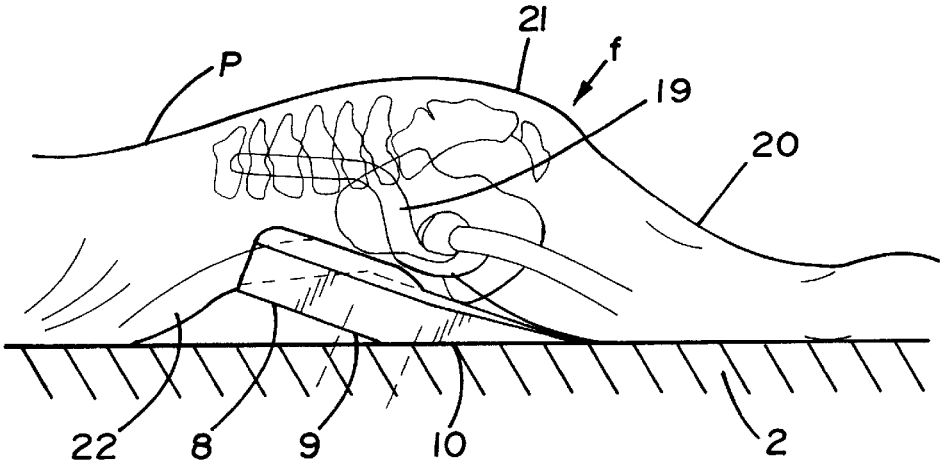
FIG. 6 is a sagittal section showing the position of the user in motion on the pelvis retroverter of the invention.

The person P then exerts a downward and forward force f via the pubis, as shown in FIG. 6. The zone 6 begins to move down and to pivot on the arc 9 while also sliding on the ground 2. Simultaneously, the top front ilium ridges of the pelvis are moved upwards and backwards by the rotary motion of the lever pivoting on the arc 9. If the movement is extreme, then the plane zone 10 comes fully into contact with the ground 2 and slides along the ground 2 under pressure from the pubis driven by contraction of the abdominal muscles. Retroversion of the pelvis is then at a maximum and the lumbar region of the spine is straightened. The intermediate zone 7 accompanies the movement beneath the abdominal of the user P. The abominable region is relieved and is subjected to no pressure that could impede respiration because of the opening in the abdominal zone 4.

The pelvis is thus caused to pivot as shown in FIG. 6, straightening lumbar lordosis and advantageously relaxing the iliopsoas muscles 19 shown in FIGS. 5 and 6, and also decompressing the disks between vertebrae. The muscular masses that are synergetic to the retroversion action are the pelvis and trochanter muscles, not shown in FIGS. 5 and 6, the ischio-tibialis muscles 20, and the gluteas-maximus muscles 21, and also the abdominal muscles 22 which play the most important part.

The pelvis retroverter 1 of the invention is made of a material suitable for obtaining the shape described and proposed in FIGS. 1, 2, 3, 7, 8, and 9. It may be in the form of a rigid hollow shell with pubis and ilium support zones 6 and 5 made comfortable by fittings secured by adhesive, clipping, or overmolding, or it may be made out of a cellular material occupying the entire volume of the pelvis retroverter.

The pelvis retroverter of the invention constitutes an appliance that is simple to use, requiring no assistance, and enabling proper positioning of the user while movements are being performed. The pelvis retroverter of the invention facilitates straightening lumbar lordosis by the synergetic action of muscles causing retroversion of the pelvis.

The invention is not limited to the examples described and shown since various modifications can be applied thereto without going beyond the ambit of the invention.

I claim:

1. A pelvis retroverter for straightening lumbar lordosis by retroverting the pelvis simultaneously with synergetic exercising of abdominal, pelvis-trochanter, gluteal, ishio-tibialis, and lumbar muscles of a front reclining user; the retroverter having a generally T-shape configuration comprising in succession, in a direction from the top of the T and along its axis of symmetry (3):

an ergonomic top face (1*a*) for supporting the front pelvic area of the user comprising:

a middle abdominal support zone (4) that is inclined, recessed forwards, and centered on the axis (3);

two ilium support zones (5) disposed symmetrically about the axis (3) on either side of the abdominal support zone (4);

a pubic support zone (6) aligned with the ilium support zones, and abutting the abdominal zone (3) and centered on the axis; and an intermediate zone (7) on either side of the abdominal support zone (4) and and extending partially around a periphery of illium support zones (5);

and a middle functional base (1*b*) opposed to and facing away from the top face and centered on the axis (3) and comprising:

a plane zone (8) parallel to the top face (2) and vertically displaced therefrom to prevent hyperlordosis, and connected to the intermediate zone (7) at one end;

a plane zone (10) connected to the end of the pubic support (6) at one end; and an arcuate portion (9) interconnecting one end each of the plane zones (8 and 10).

2. A pelvis retroverter according to claim 1, characterized in that the top face (1*a*) is vertically displaced above the plane zone (8) of the base (1*b*) by a height (h).

3. A pelvis retroverter according to claim 1, characterized in that the base (1*b*) extends over the entire width of the pelvis retroverter.

4. A pelvis retroverter according to claim 1, characterized in that the circular or elliptical arc (9) interconnecting the plane zones (8 and 10) has a radius sufficient to enable retroversion of the pelvis.

5. A pelvis retroverter according to claim 1, characterized in that the arcuate portion between the plane zone (10) and the plane zone (8) is about 20° and the plane zone is a sliding plane zone.

6. A pelvis retroverter according to claim 1, characterized in that the base (1*b*) determines a trajectory that causes retroversion of the pelvis which is run on at least two edge portions (16 and 16').

7. A pelvis retroverter according to claim 1, characterized in that the origin of the arcuate portion (9) is situated approximately vertically relative to the connection between the abdominal and pubic support zones (4 and 6).

8. A pelvis retroverter according to claim 1, characterized in that at least one freely rotatable cylinder (11) is disposed in the location of the arcuate portion (9).

9. A pelvis retroverter according to claim 1, characterized in that the base (1*b*) rests on a cradle (13) provided with freely rotatable cylinders (14 and 14').

10. A pelvis retroverter according to claim 1, characterized in that the pubic support (6) is situated in the horizontal plane and forms an angle (d) with the abdominal zone (4).

11. A pelvis retroverter according to claim 1, characterized in that the ilium support zones (5) are raised above the pubic support zone (6).

12. A pelvis retroverter according to claim 1, characterized in that it is integrated in a couch for providing care.

13. A pelvis retroverter according to claim 1, wherein the middle functional base (1*b*) opposed to the top face centered on the axis (3) determines a retroversion trajectory for the pelvis.

* * * * *